United States Patent [19]

Mühlbauer

[11] Patent Number: 4,466,571

[45] Date of Patent: Aug. 21, 1984

[54] HIGH-PRESSURE LIQUID INJECTION SYSTEM

[76] Inventor: Reinhard Mühlbauer, Theresien strasse 6, 8057 Eching, Fed. Rep. of Germany

[21] Appl. No.: 390,961

[22] Filed: Jun. 22, 1982

[30] Foreign Application Priority Data

Jun. 24, 1981 [DE] Fed. Rep. of Germany ..... 3124854

[51] Int. Cl.[3] ..... B05B 1/08

[52] U.S. Cl. ..... 239/101; 239/102

[58] Field of Search ..... 239/101, 102

[56] References Cited

U.S. PATENT DOCUMENTS

| | | | |
|---|---|---|---|
| 3,848,118 | 11/1974 | Rittberg | 239/101 |
| 3,904,347 | 9/1975 | Rokudo et al. | 239/102 X |
| 3,905,552 | 9/1975 | Hall et al. | 239/101 |
| 4,019,683 | 4/1977 | Asai et al. | 239/102 |

*Primary Examiner*—John J. Love
*Assistant Examiner*—Mary F. McCarthy
*Attorney, Agent, or Firm*—Laurence R. Brown

[57] ABSTRACT

The invention relates to a high-pressure injection system for delivering and atomizing liquids by means of ultrasonic energy and, more in particular, to a fuel injection system for diesel engines. Said system is operated in conjunction with electronic control means. The injection system comprises a housing defining a pumping chamber into which there extends the free end of an operating or pumping plunger adapted to be actuated by a vibrator. A slide valve is provided which extends through said pumping chamber and which is actuated by means of another vibrator. Together with a suction aperture and a discharge aperture, said slide valve defines a suction valve and a discharge valve, respectively, of the injection system. Under normal conditions, the vibrators associated with said plunger and said slide valve are operated in such a way that there exists a phase difference of 90° therebetween, with the result that during a suction stroke of said plunger said discharge valve is maintained closed whereas said suction valve is open, and that, during a delivery stroke of said plunger, said discharge valve is opened whereas said suction valve is maintained closed. In a gap formed around said discharge valve the fuel is atomized to a high degree during the delivery stroke of said plunger.

13 Claims, 3 Drawing Figures

HIGH-PRESSURE LIQUID INJECTION SYSTEM

TECHNICAL FIELD OF THE INVENTION

The present invention relates to a high-pressure injection system, more particularly to a fuel injection system for diesel engines which is adapted to deliver a liquid and to atomize said liquid with the aid of ultrasonic energy.

BRIEF DESCRIPTION OF THE PRIOR ART

Such injection systems serve, for example, to inject fuel into the combution chambers of diesel engines, to inject fuel directly or indirectly into gasoline engines, to operate gas turbines or furnaces in which light or heavy oil is employed or to atomize liquids in spray painting and air humidifying plants. In the cases named, it is desired to atomize the liquid to be injected to the highest possible degree. For this purpose, it is convenient to employ ultrasonic energy. For example, it has already been known to atomize the fuels employed in the carburetor systems of gasoline engines. In the case of diesel engines, however, it is necessary to provide for a high injection pressure, it being possible, for example, to employ for this purpose an injection system of the type enclosed in DE-OS 25 52 973 and DE-OS 23 04 525. In these known systems, the fuel delivered by a mechanical pump is introduced under high pressure into an injection nozzle which is provided with a piezoelectric vibration generator causing the nozzle to vibrate at an ultrasonic frequency. A ball valve provided within this device prevents the escape of fuel drops as long as the injection nozzle is not being vibrated. In order to prevent gases being compressed from entering the injection nozzle, DE-OS No. 26 08 108 proposes to provide the known arrangement described with an external ball valve which is held in position on the housing by means of a compression spring. In this arrangement, however, the ball valve and the spring are directly exposed to the pressures and temperatures occurring in the combustion chamber with the result that prolonged operation will cause these elements to be damaged.

However, injection systems in which ultrasonic energy is employed to atomize the liquid to be injected would afford advantages in comparison to the conventional mechanical injection systems if it were possible to adapt them to withstand the high loads occurring in operation. For example, it is possible to control ultrasonic vibrators with the aid of means having an extremely low inertia, this being difficult to be attained with mechanical means. Moreover, it would be possible to control such vibrators by means of simple electronic controllers. Should it be possible to provide for low-inertia control and operation of the mechanical components of high-pressure liquid injection systems, an injection system providing a high degree of efficiency would be available. Thus it would be possible considerably to increase the efficiency of machines such as diesel engines in which a high degree of utilization of the fuel has already been achieved, this being so because such a system would enable rotary speeds to be attained which are higher than those attained thus far. Similar considerations also apply for injection systems which are operated in conjunction with other devices of the type enumerated above.

OBJECT OF THE INVENTION

It is an object of the present invention to provide a high-pressure injection system in which the liquid to be injected is atomized by means of ultrasonic energy which, in conjunction with electronic control means, comprises only a minimum number of mechanical component parts and which is adapted to follow the output signal of the control means at a minimum delay, that is to say, which is characterized by the minimum possible inertia.

SUMMARY OF THE INVENTION

This object is attained, according to the present invention, by integrating the entire injection system into a single structural unit resembling a positively controlled plunger pump comprising a suction valve, a delivery valve and a piston or plunger. Thus, the conventional injection valve and injection pump are integrated into a single unit. According to this invention, all mechanical components of the injection system are operated by means of ultrasonic vibrators which are adapted to be controlled by low-inertia electronic control means. According to the invention, it is possible to provide compact high-pressure injection systems which are adapted to atomize liquids to an extremely high degree by means of ultrasonic energy.

In a preferred embodiment of the invention, the pumping chamber is penetrated by a control valve in the form of a slide valve operating as a valve body of the suction valve as well as a valve body of the injection valve. This valve member commonly associated with the two valves is acted upon by means of a second vibrator adapted to reciprocate the valve member in the direction of its axis. The bottom end of said valve member or slide valve constitutes, together with an injection aperture connected to the pumping chamber, the injection valve which may be closed by the slide valve entering the bore of the injection aperture. In the vicinity of the top end of the pumping chamber the slide valve is provided with a section of smaller diameter having an edge, said reduced portion being located in the vicinity of an inlet aperture extending from the pumping chamber to liquid supply means. The edge of this reduced portion constitutes, together with the bore of the suction aperture, the suction valve which is adapted to be closed by the slide valve entering the bore of the suction aperture with its outer diameter. The liquid, for example a fuel, is introduced into the suction valve via a supply bore with which the housing is provided in the vicinity of the inlet aperture and via the reduced portion of the slide valve. The slide valve is dimensioned in such a way that reciprocation thereof will either cause the suction valve to be opened while the injection valve is closed or the injection valve to be opened while the suction valve is closed. Besides, the slide valve can be constructed in such a way that, when in its inoperative position, i.e. with the vibrator out of operation, both of said valves are closed.

In a preferred embodiment of the invention, said slide valve is coupled to the vibrator associated therewith by means of an elastic driving rod which is provided with an inertia body. Said elastic rod constitutes, together with said inertia body and the mass of the slide valve, a vibratory system which is adapted, by tuning to the operational frequency of the ultrasonic vibrator, to multiply the amplitude of the vibrations of the slide valve as compared to the amplitude of the vibrations of the vibrator in such a manner that sufficiently large open cross-sections can be attained at both the suction valve and the discharge valve and that, in addition, the manufacturing tolerances prescribed for the functionally important dimensions of the two valves are maintained within reasonable limits.

The free end of an operating plunger which is directly coupled to the second vibrator is arranged to be projected into the enclosed pumping chamber.

In a preferred embodiment, the two ultrasonic vibrators may be attached to the housing of the unit and pretensioned by means of two hollow bolts. The two vibrators may be constructed in the manner of conventional oscillators as employed in power ultrasonics, it being only necessary to cause the sonic energy to be transmitted in opposite directions through the hollow mounting bolts.

The axes of the two movable components, i.e. the operating plunger and the slide valve, may advantageously be disposed in such a manner in relation to one another as to constitute a V-shaped arrangement in order to minimize both the space required by the unit in the vicinity of the injection valve and the sealing surface of the injection system as well as in the vicinity of the driven part of the system and the resulting reaction forces produced by the two oscillators.

In the vicinity of the injection valve, the free end of the slide valve is provided with an ejection surface comprising, for example, a portion of partly spherical convex shape and a conical portion adapted to determine the discharge angle. Said conical portion and the spherical portion at the end of the slide valve constitute the only components which are directly exposed to the conditions existing in the system to be operated by means of the injection system. If a diesel engine is involved, it is only these components which are exposed to the pressures, temperatures and combustion gases occurring in the cylinder head. By means of positively controlling the slide valve and by providing suitable guiding surfaces on these components it is possible in a simple manner to control the pressure and temperature effects.

The entire arrangement is operated by means of an electronic control circuit which is designed to coordinate the motions of the slide valve and the pump plunger in such a way that the plunger will carry out a delivery stroke while the discharge valve is open, whereas the plunger carries out a suction stroke while the suction valve is open. Normally, a phase difference of 90° exists between the motions carried out by the slide valve and the plunger, respectively. To permit the fuel injected per pump stroke to be controlled, however, it is possible to vary this phase difference by means of the control system; for the same purpose it is possible to vary the amplitude of the vibrations of the plunger, i.e. its stroke length.

The advantages afforded by the invention, particularly when applied to a diesel engine, accrue from the fact that it is no longer necessary to provide a mechanically complicated and expensive injection pump and the drive elements required for its operation. It is also possible to omit the conventional conduits connecting the pump to the injection valves provided in the cylinder head. The development of diesel engines of small size yet of high power has, according to the prior art, been hampered for a long time by the mechanical conditions imposed by conventional pump structures and the transit time of pressure waves in the liquid to be atomized present in said connecting conduits. These disadvantages are not present in the injection system of the invention since the pump and the injection valve are integrated into a single unit which is adapted to be directly mounted on the cylinder head of a diesel engine. This is, of course, also true of other machinery and equipment of the type mentioned earlier.

In view of the scarcity of raw materials and the legislation requiring a reduction in the emission of exhaust gases in order to provide environmental protection, it has become necessary to provide engines of ever-increasing efficiency emitting smaller amounts of noxious substances, only engines designed for fuel injection being capable of meeting such requirements. Proper processing of all parameters governing optimum injection conditions makes it necessary to provide for electronic process control means which are adapted accurately to calculate such factors as start of injection, duration of injection and amount of liquid injected per unit time on the basis of a three-dimensional family of characteristics. However, thus far no systems are known which are capable of transforming the output signal of a control system with minimum possible delay into corresponding mechanical quantities. The injection system of the invention permits all of these parameters to be controlled in the desired manner since its inertia is low and since it permits the amount of liquid injected per unit time to be controlled by varying the length of stroke of the pump plunger and/or the phase relation between the motions of the slide valve and the plunger without jeopardizing the quality of atomization of the liquid (fuel) because atomization is effected by means of ultrasonic energy.

Another advantage afforded by the invention is to be seen in the fact that the electrical energy available at the output of the control system is directly converted into pressure energy without use being made of any intermediate actuators or pumps with the result that the entire system requires the employment of a relatively small number of mechanical component parts only.

BRIEF DESCRIPTION OF THE DRAWINGS

The invention and further particulars will be described more specifically hereinafter with reference to preferred embodiments shown in the drawings, in which.

DETAILED DESCRIPTION OF THE PREFERRED EMBODIMENTS OF THE INVENTION

Figure 2:
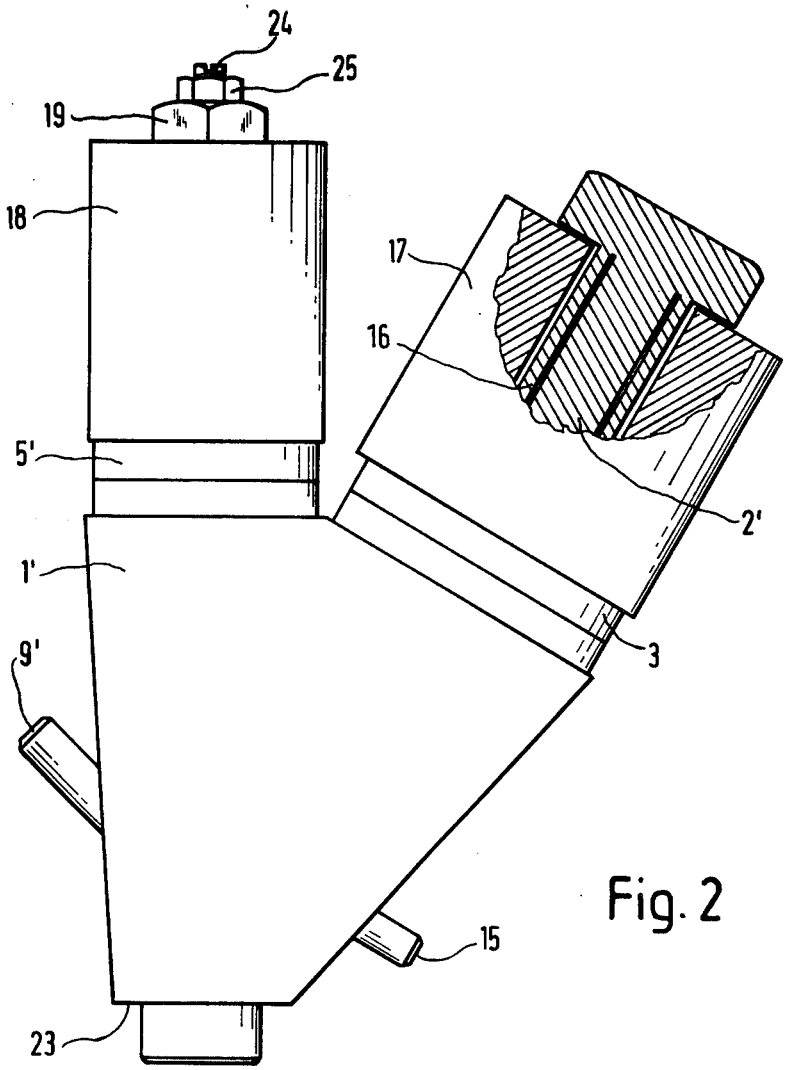
FIG. 2 is a partially sectioned side elevation of a second embodiment of a fuel injection system according to the invention.
Figure 3:
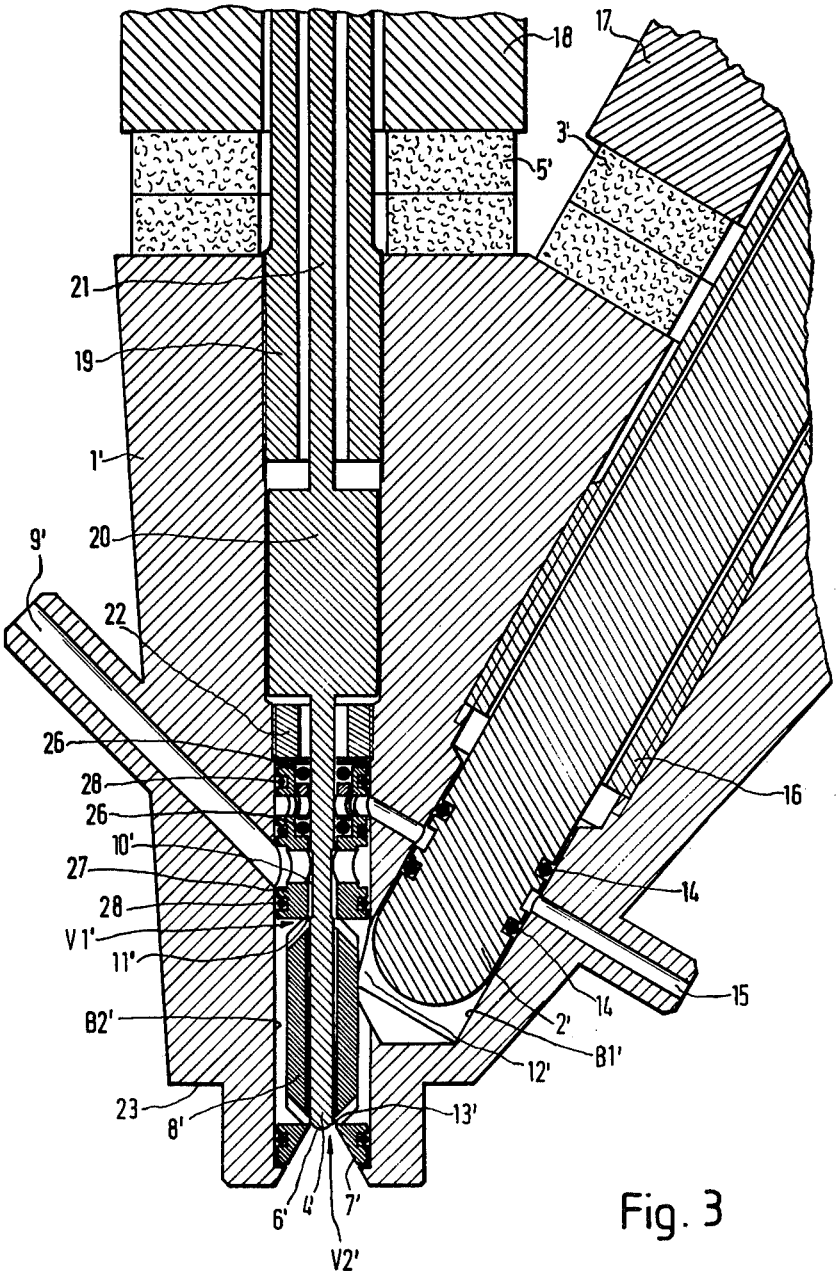
FIG. 3 is an enlarged partial sectional view of the fuel injection system of FIG. 2 showing additional details.

In the Figures, component parts of identical design or serving identical functions are designated with similar reference numbers to which a prime has been added in FIGS. 2 and 3.

A housing 1 of compact design defines a pumping chamber 12, the peripheral wall of which is provided with an aperture B1. Slidably guided in aperture B1 is a cylindrical plunger 2, the free end of which extends into pumping chamber 12; the opposite end of plunger 2 is connected, externally of housing 1, to a vibrator 3 supported by housing 1; vibrator 3 comprises, for example, two annular piezoelectric transducers which are adapted, when operated by electric means, to reciprocate plunger 2 in the direction of its axis, i.e. in the manner indicated in FIG. 1 by double-headed arrow P1.

The opposed end walls of pumping chamber 12 are provided with two coaxial apertures B2 and B3 constituting a suction valve V1 and a discharge valve V2, respectively, there being slidably guided in said apertures a slide valve member 4 extending through pumping chamber 12 transversely of the axis of plunger 2. Slide valve 4 is adapted to be reciprocated in the direction of double-headed arrow P2 of FIG. 1 along the two apertures B2 and B3 by means of another vibrator 5 disposed externally of housing 1.

The free bottom end of slide valve 4 extending into aperture B3 is provided with an ejecting surface 6 formed by a segment of a spherical surface. Aperture B3 terminates in a conical discharge section 7 which is, in turn, connected to the combustion chamber of a diesel engine.

Between apertures B2 and B3 slide valve 4 is guided by a sliding bearing means 8 adapted to prevent lateral vibrations of slide valve 4, thus preventing the suction and discharge valves from being damaged.

In the vicinity of suction aperture B2, slide valve 4 is provided with a reduced portion 10 having a bottom control edge 10*a*, the slide valve provided with said reduced section forming suction valve V1 together with said bore. Connected to the suction valve is a fuel supply line 9 mounted in a bore of housing 1 and extending to a point in the vicinity of reduced section 10.

With slide valve 4 at rest, i.e. with vibrator 5 out of operation, both valves V1 and V2 are closed because slide valve edge 10*a* blocks suction aperture B2 of the inlet valve, whereas the free bottom end of the slide valve keeps the discharge aperture B3 of discharge valve V2 closed in relation to pumping chamber 12.

Figure 1:
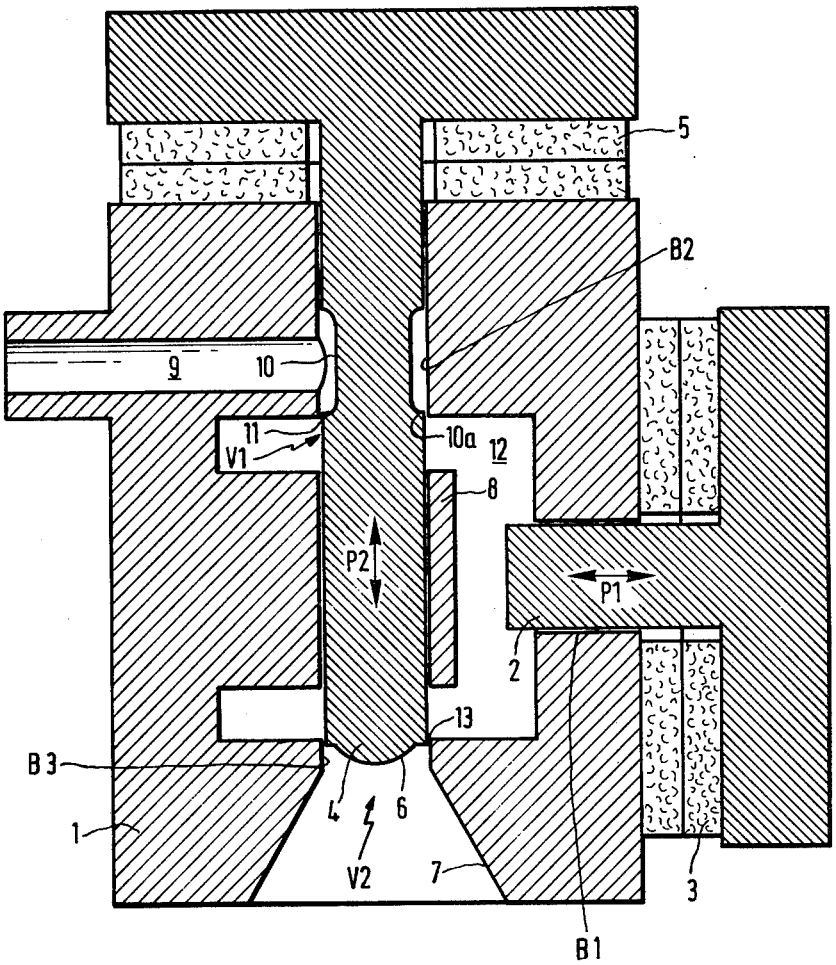
FIG. 1 is a longitudinal cross-section of a first embodiment of a fuel injection system according to the invention.

Upon slide valve 4 being advanced into its lowermost position in discharge aperture B3, suction valve V1 is operated to open a narrow inlet gap 11 between slide valve edge 10*a* and aperture B2 while discharge valve V2 continues to be kept closed. Upon plunger 2 being pulled to the right as seen in FIG. 1, fuel will be drawn into pump chamber 12 via fuel supply line 9, reduced section 10 and inlet gap 11. Upon slide valve 4 then being brought into its uppermost position, suction valve V1 will be closed while discharge valve V2 is opened in such a way that a narrow discharge gap 13 is formed between the bottom end of slide valve 4 and aperture B3. As plunger 2 is now being moved towards the left in FIG. 1, it will displace the fuel just drawn in, which can only escape via discharge valve V2. Subsequently slide valve 4 is brought again into its lowermost position, this causing the part-spherical discharge surface 6 to accelerate the fuel present in the space therebelow with the result that said fuel will be atomized to a high degree and caused to be discharged by conical portion 7 at a high rate of speed.

This constitutes the end of a cycle which includes drawing-in and atomization of a fuel charge, after completion of which the initial condition described above is restored so that another cycle may be started. Of course, the slide valve and the plunger perform their motions in a continuous manner, for example in the form of a sinusoidal vibration corresponding to a control signal produced by electronic control means (not shown). As described above, there is a phase difference of 90° between the motions respectively performed by slide valve 4 and plunger 2.

If it is intended to vary the amount of fuel to be injected per pump cycle, it is possible either to vary the amplitude of the vibrations performed by plunger 2 or to vary the abovementioned phase relationship between the motions performed by slide valve 4 and plunger 2. It is, of course, also possible to employ a combination of these two possibilities.

Shown in FIGS. 2 and 3 is an embodiment of an injection system according to the invention which is provided with a downwardly facing sealing surface 23 at the lower end of its housing 1', said sealing surface being adapted to be disposed about the injection valve mounting surface of a conventional diesel engine. The mounting means such as screws or bolts are not shown in the drawing.

FIG. 2 is a partially sectioned elevational view of the injection system showing the manner of attachment of a vibrator 3' and the power transmission means extending therethrough.

FIG. 3 is an enlarged cross-sectional detail showing further particulars of the embodiment of FIG. 2.

The longitudinal axes of plunger 2' and slide valve 4' form a V-shaped arrangement with the free end of plunger 2' again extending into pumping chamber 12', whereas slide valve 4' extends through pumping chamber 12' throughout the length thereof. As compared to the first embodiment described earlier, pumping chamber 12' is of small capacity. Plunger 2' is provided with two sealing rings 14, 14 cooperating with the wall of aperture B1', a leakage path 15 extending out of housing 1 from a point located between the two sealing rings. Plunger 2' extends through a hollow screw 16 and is attached to the head of this screw only. Hollow screw 16 clamps vibrator 3' and a retaining member 17 disposed on its outer face to housing 1'. The vibrations produced by vibrator 3' are transmitted to plunger 2' by retaining member 17 and hollow screw 16.

Slide valve 4' is supported in housing 1' in a similar manner. Oscillator 5' is provided with a retaining member 18 which is clamped to housing 1' by means of a hollow retaining screw 19. Screwed into position together with the head of hollow screw 19 is an elastic drive rod 21 which is adapted to be locked in position by means of a lock nut 25 shown in FIG. 2. Vertical adjustment of drive rod 21 and locking thereof can be effected by means of lock nut 25 and the upper end portion of drive rod 21 which is provided with a threaded portion 24 to permit adjustment. Near the bottom end of hollow screw 19 the elastic drive rod 21 is provided with a cylindrical inertia body 20 having attached to its lower end the slide valve 4' proper. The guide member 8' for slide valve 4', together with suction valve V1' and discharge valve V2', is designed to form an independent component part because it is required to be made of a high-grade material and to be machined to close tolerances. This insert member is mounted in an aperture B2' and clamped in position by means of a screw 22 disposed below inertial body 20. Slide valve 4' extends through insert 8' and is provided with another pair of sealing rings 26, 26 cooperating with the insert. An extension of leakage path 15 terminates in the space existing between these two sealing rings. Insert 8' is provided with a cover plate 27 closing the upper end of injection chamber 12'. Several seals 28 are provided to seal the entire insert 8' in relation to housing aperture P2'. At a point above cover plate 27, fuel supply line 9' is connected to suction valve V1', i.e. in the vicinity of the reduced portion 10' of slide valve 4'.

By reciprocating slide valve 4' in the manner described earlier it is possible to open and close, respectively, the suction valve V1' cooperating with inlet gap 11' on the one hand and discharge or injection valve V2' comprising the injection gap 13' on the other.

The injection system shown in FIGS. 2 and 3 operates in the manner described in relation to the first embodiment shown in FIG. 1. The inertia body 20 provided with the elastic drive rod 21 serves the function of forming an oscillatory mechanical system which is required to have the same natural resonance as oscillator 5' so as to cause the amplitude of the motions performed by the slide valve to be increased.

In this injection system, only the discharge surface 6' of slide valve 4' and the conical wall 7' of the discharge aperture will be exposed to the combustion gases as well as the pressures and temperatures occurring in the combustion chamber of the diesel engine associated therewith.

What is claimed is:

1. A high-pressure injection system for pumping liquids and atomizing them by means of ultrasonic energy, more in particular a fuel injection system for diesel engines, characterized in that said injection system is constructed as a structural unit of the positively controlled plunger pump type comprising a pump housing which defines a pumping chamber completely filled with liquid, a suction valve and a discharge valve as well as a plunger extending into said pumping chamber, and in that the valve members of said suction valve and said discharge valve as well as said plunger are coupled to ultrasonic vibrators which are operable in a controlled manner for the purpose of causing liquid to be drawn in through said suction valve and to be ejected via said discharge valve.

2. The injection system of claim 1, characterized in that said pumping chamber is provided with a suction aperture for said suction valve and with a discharge aperture for said discharge valve, said apertures having associated therewith a common slide valve forming a valve member of said suction valve and said discharge valve, respectively, said valve member being coupled to a single ultrasonic vibrator which acts alternatively to open and close said suction valve and said discharge valve.

3. The injection system of claim 2, characterized in that said slide valve is guided by guide means in said pumping chamber between said suction valve and said discharge valve.

4. The injection system of claim 2 or claim 3, characterized in that said slide valve is provided, in the vicinity of said suction aperture, with a reduced portion having a control edge facing said pumping chamber, said control edge operable to open said suction aperture by defining an inlet gap permitting liquid to be drawn into said pumping chamber and to close said suction aperture in relation to said pumping chamber.

5. The injection system defined in claim 2 or 3, characterized in that said slide valve in its inoperative position with its respective ultrasonic vibrator not being excited holds said suction valve and said discharge valve closed.

6. The injection system defined in claim 2 or 3, characterized in that said slide valve is provided with a free end disposed in the vicinity of said discharge valve having a discharging surface operable to atomize the liquid to a high degree.

7. The injection system defined in claim 2 or 3, characterized in that, for the purpose of increasing the amplitude of the vibrations of said slide valve, the slide valve is coupled to the ultrasonic vibrator associated therewith by means of an elastic drive rod carrying an inertia body, the mechanical properties of said elastic drive rod and said inertia body being matched with the operational frequency of said vibrator.

8. The injection system defined in claim 2 or 3, characterized in that the longitudinal axes of said plunger and said slide valve are disposed to constitute a V-shaped arrangement.

9. The injection system defined in claim 2, characterized in that a phase difference of 90° is maintained between the phase of the vibrations of said plunger and the phase of the vibrations of said slide valve which is commonly associated with said suction valve and said discharge valve.

10. The injection system defined in any one of claims 1 to 3, characterized in that said vibrators are mounted on said pump housing and clamped thereto by means of hollow screws with a plunger and elastic drive rod extending through the central cavities of said screws.

11. The injection system defined in claim 1, characterized in that said controlled manner is effected in such a way that a 180° phase is provided between said suction valve and said discharge valve, and that a 90° phase is provided for said plunger in relation to said suction valve.

12. The injection system defined in any one of claims 11 or 9 a pumping cycle is created and characterized in that, for the purpose of varying the amount of liquid to be injected per pumping cycle, the phase relationships between the vibrations of said plunger and said valve members slide valve associated with said suction valve and said discharge valve are variable.

13. The injection system defined in any one of claims 1 to 3, 11 or 9, characterized in that a pumping cycle is created and for the purpose of varying the amount of liquid to be injected per pumping cycle, the amplitude of the vibrations, i.e. the length of stroke of said plunger, is variable.

* * * * *